US011418896B1

(12) United States Patent
Ching

(10) Patent No.: US 11,418,896 B1
(45) Date of Patent: Aug. 16, 2022

(54) SELF-ADAPTIVE ADJUSTMENT METHOD AND HEARING AID USING SAME

(71) Applicant: Compal Electronics, Inc., Taipei (TW)

(72) Inventor: Yun-Chiu Ching, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 17/369,226

(22) Filed: Jul. 7, 2021

(30) Foreign Application Priority Data

May 21, 2021 (TW) ..... 110118534

(51) Int. Cl.
*H04R 25/00* (2006.01)

(52) U.S. Cl.
CPC ..... *H04R 25/505* (2013.01); *H04R 2225/41* (2013.01); *H04R 2430/01* (2013.01)

(58) Field of Classification Search
CPC ..... H04R 25/505; H04R 2225/41; H04R 2430/01
See application file for complete search history.

(56) References Cited

U.S. PATENT DOCUMENTS 10,109,293 B2 * 10/2018 Tu ..... H04R 25/356
10,595,135 B2 * 3/2020 Li ..... H04R 25/50
10,848,881 B2 * 11/2020 Fitz ..... H04R 25/505
2005/0078838 A1 4/2005 Simon
2008/0219459 A1 9/2008 Bonfiovi et al.

FOREIGN PATENT DOCUMENTS

| | | | |
|---|---|---|---|
| CN | 109327785 B | | 10/2020 |
| CN | 106921926 B | * | 11/2020 |
| TW | I590236 B | | 7/2017 |
| TW | I609365 B | | 12/2017 |
| TW | I623234 B | | 5/2018 |
| TW | I711942 B | | 12/2020 |
| TW | 202110207 A | | 3/2021 |

* cited by examiner

*Primary Examiner* — Brian Ensey
(74) *Attorney, Agent, or Firm* — Kirton McConkie; Evan R. Witt

(57) ABSTRACT

A self-adaptive adjustment method for a hearing aid is provided. Audio adjustment parameters including a first audio compression rate, a second audio compression rate and a preset volume compression threshold are previously stored in the hearing aid. The self-adaptive adjustment method includes (S1) receiving and converting an external sound source into an input audio signal, (S2) converting the input audio signal into a first output audio signal at a first audio compression rate, (S3) determining a relative relation between the set output volume level and the default volume level of the hearing aid, calculating a dynamic volume compression threshold, and comparing and determining whether the volume of the input audio signal is greater than the dynamic volume compression threshold, and (S4) converting the input audio signal into a second output audio signal at a second audio compression rate.

9 Claims, 6 Drawing Sheets

SELF-ADAPTIVE ADJUSTMENT METHOD AND HEARING AID USING SAME

FIELD OF THE INVENTION

The present invention relates to a hearing aid, and more particularly to a self-adaptive adjustment method and a hearing aid using the self-adaptive adjustment method.

BACKGROUND OF THE INVENTION

In terms of adaptation, hearing aids are mainly divided into two types, including programmable hearing aids and non-programmable hearing aids. In accordance with the non-programmable hearing aid, hearing loss parameters are burnt into the hearing aids according to the preset degree of hearing loss, and a more suitable hearing aid is selected through the speech banana area of the patient's audiogram. The self-adaptive part of the non-programmable hearing aid is mainly based on a low-pass filter button, a high-pass filter button and a band-pass filter button of the non-programmable hearing aid, and supplemented by a total volume adjustment button as an adjustment system.

In accordance with the programmable hearing aid, the patient's audiogram is converted into corresponding signatures (for example, NAL-NL2 matching formula) as audio adjustment parameters through adaptation software by the audiologist, and the audio adjustment parameters are stored into a wide dynamic range compression (WDRC) device of the programmable hearing aid through a burning process. The main function of the WDRC device is to increase the volume gain value of the input audio signal with a low volume to facilitate identification, and to reduce the volume gain value of the input audio signal with a large volume to avoid discomfort caused by too much sound. Moreover, when the volume of the output audio signal exceeds the range that the human ears can load, the WDRC device enables a maximum power output (MPO) limit function to limit the volume within a certain range in order to protect the ears from hearing damage. Moreover, the self-adaptive part of the programmable hearing aid is operated by using APP or the multi-channel equalizer button of the programmable hearing aid in cooperation with the total volume adjustment button as an adjustment system. In comparison with non-programmable hearing aids, programmable hearing aids have the advantages of wider applicability and the ability to adjust hearing aids at any time according to the changes of the user's hearing loss.

Please refer to FIGS. 1 and 2. FIG. 1 is a schematic diagram illustrating the relationship between the input audio signal and the output audio signal of a conventional control-output compression-type programmable hearing aid when the wide dynamic range compression is performed at three set output volume levels. FIG. 2 is a schematic diagram illustrating the relationship between the input audio signal and the basic gain of the control-output compression-type programmable hearing aid as shown in FIG. 1.

Generally, when a hearing aid is worn on a user, the hearing attenuation curve of the user is compensated for different gains at different frequencies. In FIGS. 1 and 2, the relationship between the input audio signal and the output audio signal, and the relationship between the input audio signal and the basic gain are obtained at a specified frequency. If the user adjusts the output volume of the hearing aid to different set output volume levels, there are different conversion curves at this frequency. For example, in FIGS. 1 and 2, three curves A, B and C corresponding to three different set output volume levels are shown. The curve A represents that the set output volume level of the hearing aid is adjusted to the maximum volume level. The curve B represents that the set output volume level of the hearing aid is reduced by 10 dB SPL from the maximum volume level. The curve C represents that the set output volume level of the hearing aid is reduced by 20 dB SPL from the maximum volume level. Conventionally, the audio adjustment parameters corresponding to one of the three curves A, B and C can be pre-recorded in the hearing aid. For example, the audio adjustment parameters corresponding to the curve B are pre-recorded in the hearing aid, and the audio adjustment parameters corresponding to the other curves can be calculated according to the pre-recorded audio adjustment parameters.

A conventional operating method of an automatic gain control-output (AGC-o) compression-type programmable hearing aid will be described as follows. Firstly, the basic gain value is calculated according to the volume compression threshold (or knee point), the compression ratio, g50 (i.e., the gain value of the input audio signal at 50 dB SPL), g65, g80 and other appropriate audio adjustment parameters, which is included in the corresponding signatures converted from the patient's audiogram. As the sound volume is increased or decreased, a fixed output compression method is used to drive the compressor to compress the sound. For example, in the curves A, B and C, the compression ratio of the input level to the output level is 1:1 when the output volume level is lower than 90 dB SPL, and the compression ratio of the input level to the output level is 2:1 when the output volume level reaches 90 dB SPL. Consequently, the knee points for the curves A, B and C are different. For example, the knee point for the curve A occurs at the input audio signal of 40 dB SPL (i.e., the volume compression threshold is 40 dB SPL), the knee point for the curve B occurs at the input audio signal of 50 dB SPL (i.e., the volume compression threshold is 50 dB SPL), and the knee point for the curve C occurs at the input audio signal of 60 dB SPL (i.e., the volume compression threshold is 60 dB SPL).

As described in FIGS. 1 and 2, the volume compression threshold in the audio adjustment parameters is actually set according to whether the output audio signal reaches the set threshold. Since the set thresholds for output audio signals at different set output volume levels are identical (e.g., 90 dB SPL for the curves A, B and C of FIG. 1), some drawbacks occur. For example, when the user adjusts the sound volume through the APP or the buttons of the hearing aid to increase the volume, it is easy to frequently enable the maximum power output (MPO) limiting function, and the instantaneous loud volume is over-amplified to cause discomfort to the user. When the volume is decreased, the sound dynamic range is lost. Moreover, when the volume is increased or decreased, it is necessary to re-adjust g50, g65 and g80 to calculate the adjusted wide dynamic range compression gain value. Due to the high calculation result, the production cost of the conventional hearing aid is higher.

Therefore, there is a need of providing a self-adaptive adjustment method and a hearing aid using the self-adaptive adjustment method in order to overcome the drawbacks of the conventional technologies.

SUMMARY OF THE INVENTION

An object of the present invention is to provide a self-adaptive adjustment method and a hearing aid using the self-adaptive adjustment method. When the user adjusts the sound volume, it is not necessary to frequently enable the maximum power output (MPO) limiting function, and the instantaneous loud volume is not over-amplified to cause discomfort to the user. In addition, the sound dynamic range is wider, and the production cost of the hearing aid is reduced.

In accordance with an aspect of the present invention, a self-adaptive adjustment method for a hearing aid is provided. At least one audio adjustment parameter is previously stored in the hearing aid. The at least one audio adjustment parameter includes a first audio compression rate, a second audio compression rate and a preset volume compression threshold. The preset volume compression threshold is adapted as a set output volume level is equal to a default volume level of the hearing aid. The self-adaptive adjustment method includes the steps of: (S1) receiving an external sound source, and converting the external sound source into an input audio signal; (S2) converting the input audio signal into a first output audio signal at a first audio compression rate, and converting the first output audio signal into an output sound source, wherein a first gain value exists between the first output audio signal and the input audio signal; (S3) determining a relative relation between the set output volume level and the default volume level of the hearing aid, wherein when the determining result indicates that an offset value is formed between the set output volume level and the default volume level, calculates a dynamic volume compression threshold according to the preset volume compression threshold, the second audio compression ratio and the offset value, and compares and determines whether the volume of the input audio signal is greater than the dynamic volume compression threshold; and (S4) converting the input audio signal into a second output audio signal at a second audio compression rate, and converting the second output audio signal into the output sound source, wherein a second gain value exists between the second output audio signal and the input audio signal. When the determining result of the step (S3) indicates that the volume of the input audio signal is higher than the dynamic volume compression threshold, the step (S4) is performed, and when the determining result of the step (S3) indicates that the volume of input audio signal is lower than or equal to the dynamic volume compression threshold, the step (S2) is repeatedly done.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 3:
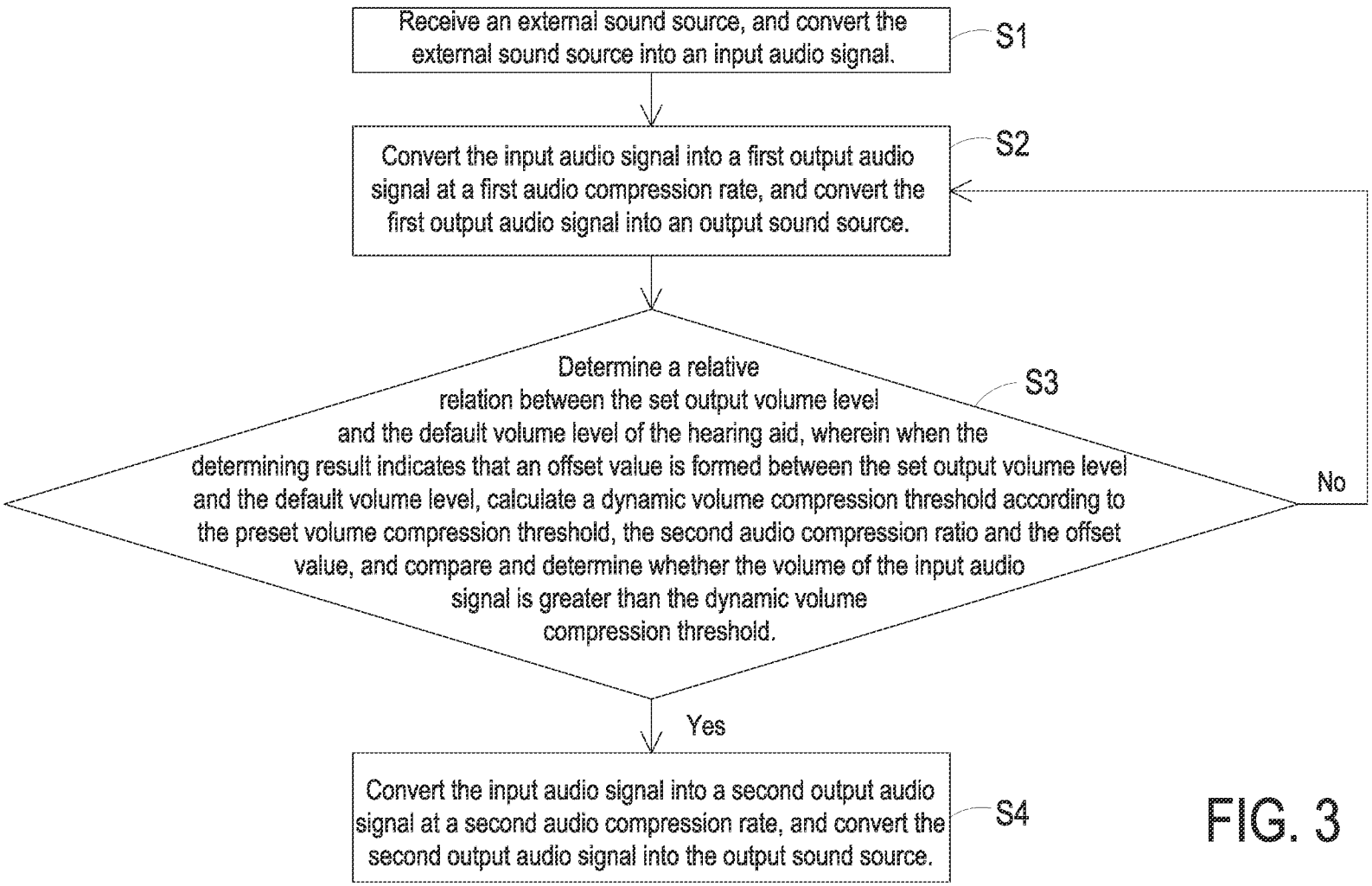
FIG. 3 is a flowchart of a self-adaptive adjustment method according to an embodiment of the present invention.
Figure 4:
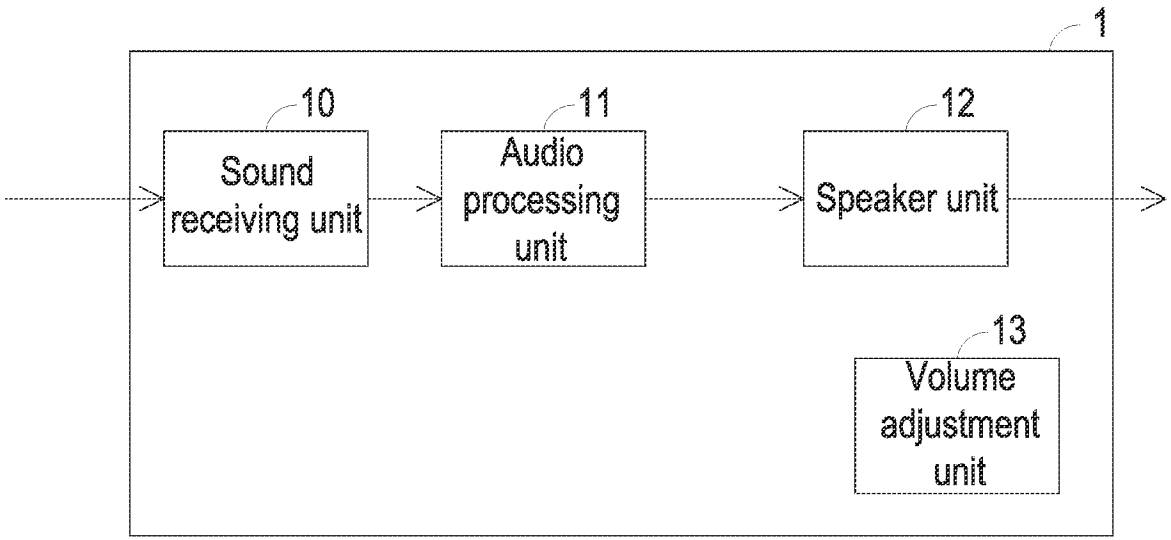
FIG. 4 is a schematic functional diagram illustrating a hearing aid using the self-adaptive adjustment method of the present invention.
Figure 5:
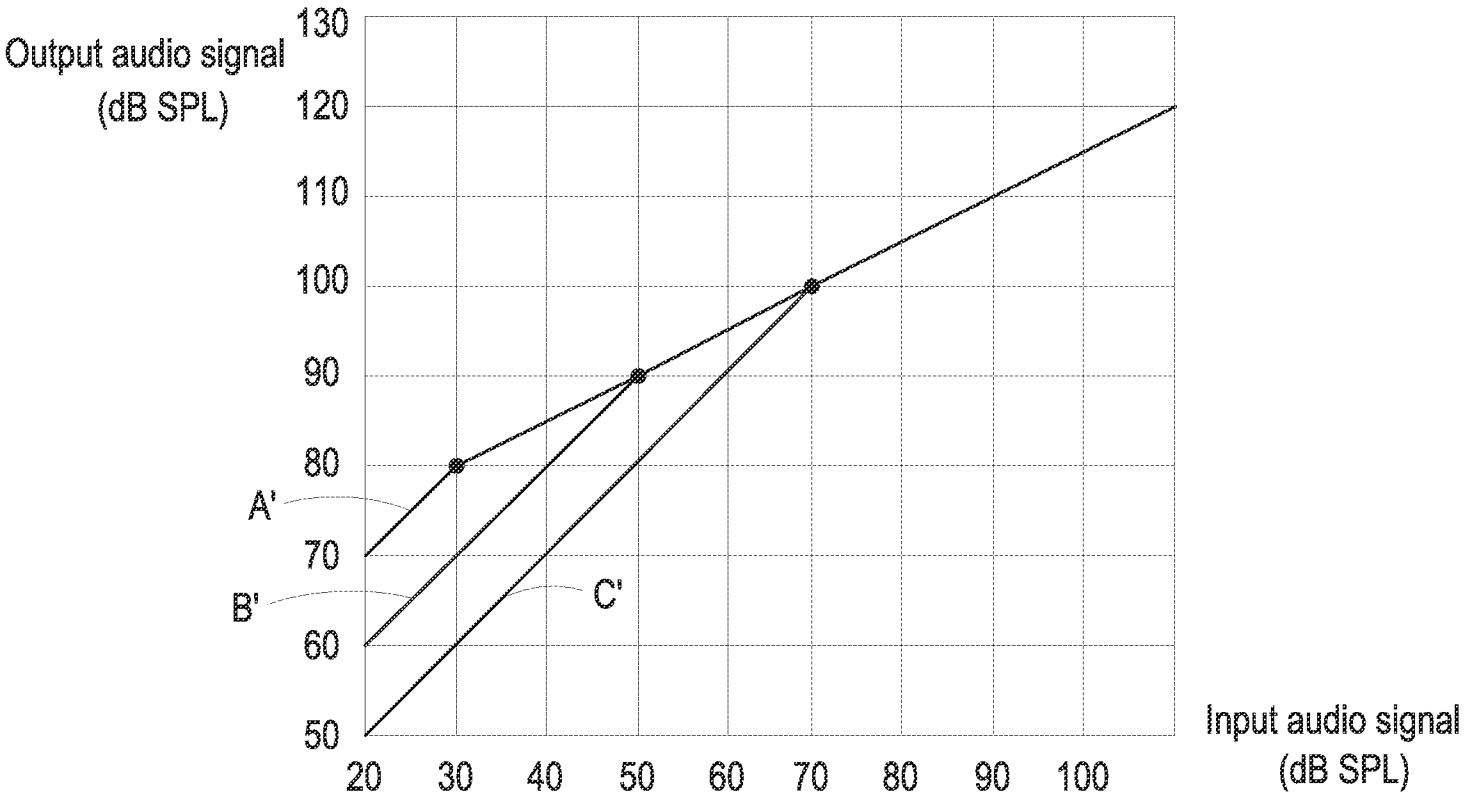
FIG. 5 is a schematic diagram illustrating the relationship between the input audio signal and the output audio signal of the hearing aid using the self-adaptive adjustment method of the present invention when the wide dynamic range compression is performed at three set output volume levels.
Figure 6:
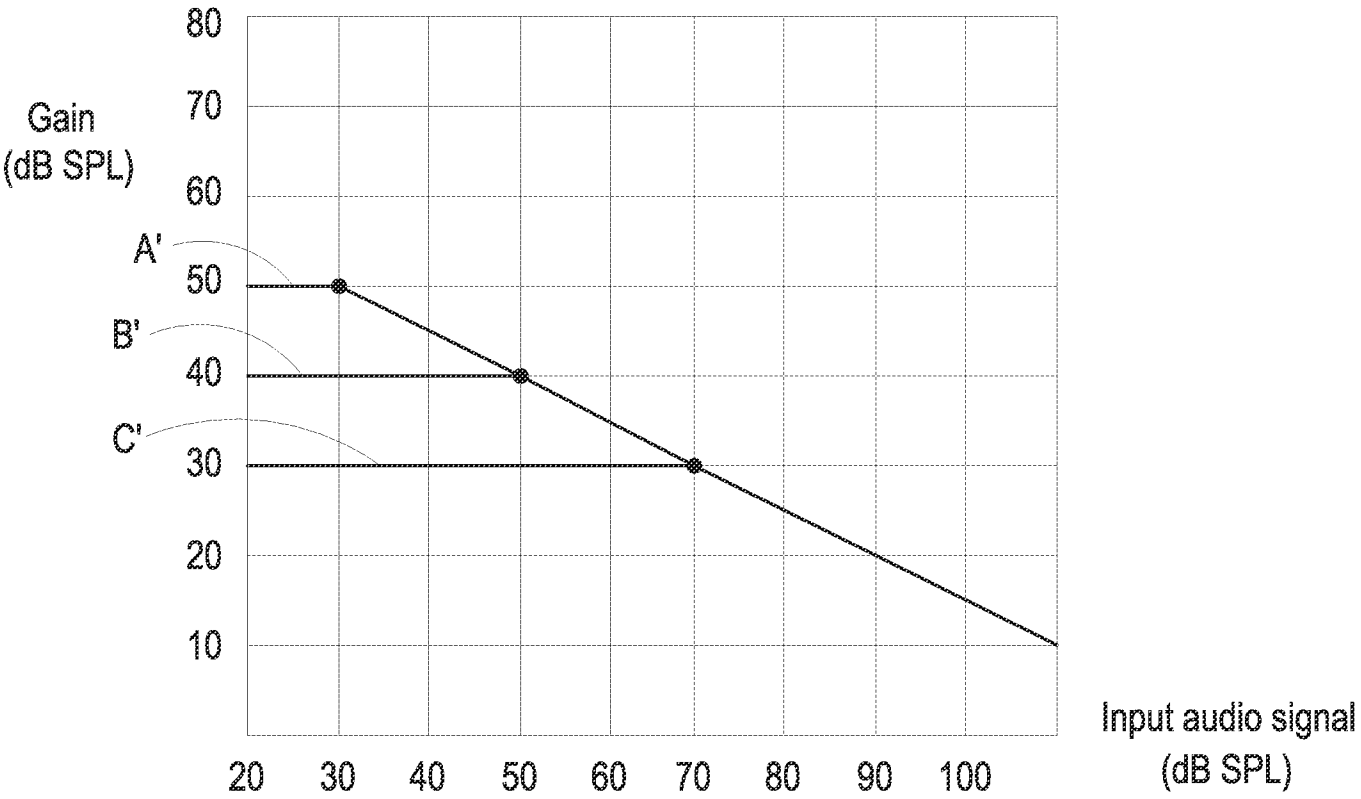
FIG. 6 is a schematic diagram illustrating the relationship between the input audio signal and the basic gain of the hearing aid using the self-adaptive adjustment method of the present invention.

Please refer to FIGS. 3, 4, 5 and 6. FIG. 3 is a flowchart of a self-adaptive adjustment method according to an embodiment of the present invention. FIG. 4 is a schematic functional diagram illustrating a hearing aid using the self-adaptive adjustment method of the present invention. FIG. 5 is a schematic diagram illustrating the relationship between the input audio signal and the output audio signal of the hearing aid using the self-adaptive adjustment method of the present invention when the wide dynamic range compression is performed at three set output volume levels. FIG. 6 is a schematic diagram illustrating the relationship between the input audio signal and the basic gain of the hearing aid using the self-adaptive adjustment method of the present invention.

The self-adaptive adjustment method is applied to the hearing aid 1. The use of the self-adaptive adjustment method can assist the hearing aid 1 to self-adjust and process the external sound source so as to improve the sound perception required by the user. The hearing aid 1 includes a sound receiving unit 10, an audio processing unit 11, a speaker unit 12 and a volume adjustment unit 13. The sound receiving unit 10, e.g., a microphone, is used to receive an external sound source and convert the external sound source into an input audio signal. The volume adjustment unit 13 is for example a volume adjustment button for the user to adjust the set output volume level of the hearing aid 1.

In an embodiment, the hearing aid 1 is a control-output compression-type programmable hearing aid, for example but not limited to an automatic gain control-output (AGC-o) compression-type programmable hearing aid. The audio adjustment parameters can be stored in the hearing aid 1 by a burning method. The audio adjustment parameters include a first audio compression rate, a second audio compression rate and a preset volume compression threshold (or referring to as a preset knee point). The preset volume compression threshold is determined as the set output volume level is equal to a default volume level of the hearing aid 1. When the set output volume level is adjusted to be equal to the default volume level through the volume adjustment unit 13, the preset volume compression threshold is served as a determining basis for converting the input audio signal into the output audio signal at the first audio compression rate or the second audio compression rate. In addition, the first audio compression rate is greater than the second audio compression rate. For example, the first audio compression rate is 1:1, and the second audio compression rate is 2:1.

In some embodiments, the audio adjustment parameters further include g50, g65 and g80 and a maximum power output (MPO) limit value. When the hearing aid 1 is worn on a user, the hearing attenuation curve of the user is compensated for different gains at different frequencies. In FIGS. 5 and 6, the relationship between the input audio signal and the output audio signal and the relationship between the input audio signal and the basic gain are obtained at a specified frequency. If the user adjusts the output volume of the hearing aid 1 to different set output volume levels, there are different conversion curves at this frequency. Since the output audio signal is the sum of the input audio signal and the gain value, the curve A' indicated in FIG. 5 and the curve A' indicated in FIG. 6 represent the same audio conversion relationship. For example, in FIGS. 5 and 6, three curves A', B' and C' corresponding to three different set output volume levels are shown. The curve A' represents that the set output volume level of the hearing aid 1 is adjusted to the maximum volume level. The curve B' represents that the set output volume level of the hearing aid 1 is reduced by 10 dB SPL from the maximum volume level. The curve C' represents that the set output volume level of the hearing aid 1 is reduced by 20 dB SPL from the maximum volume level. The audio adjustment parameters corresponding to one of the three curves A', B' and C' can be pre-recorded in the hearing aid 1. For example, the audio adjustment parameters corresponding to the curve B' are pre-recorded in the hearing aid 1, and the audio adjustment parameters corresponding to the other curves can be calculated according to the pre-recorded audio adjustment parameters.

Figure 2:
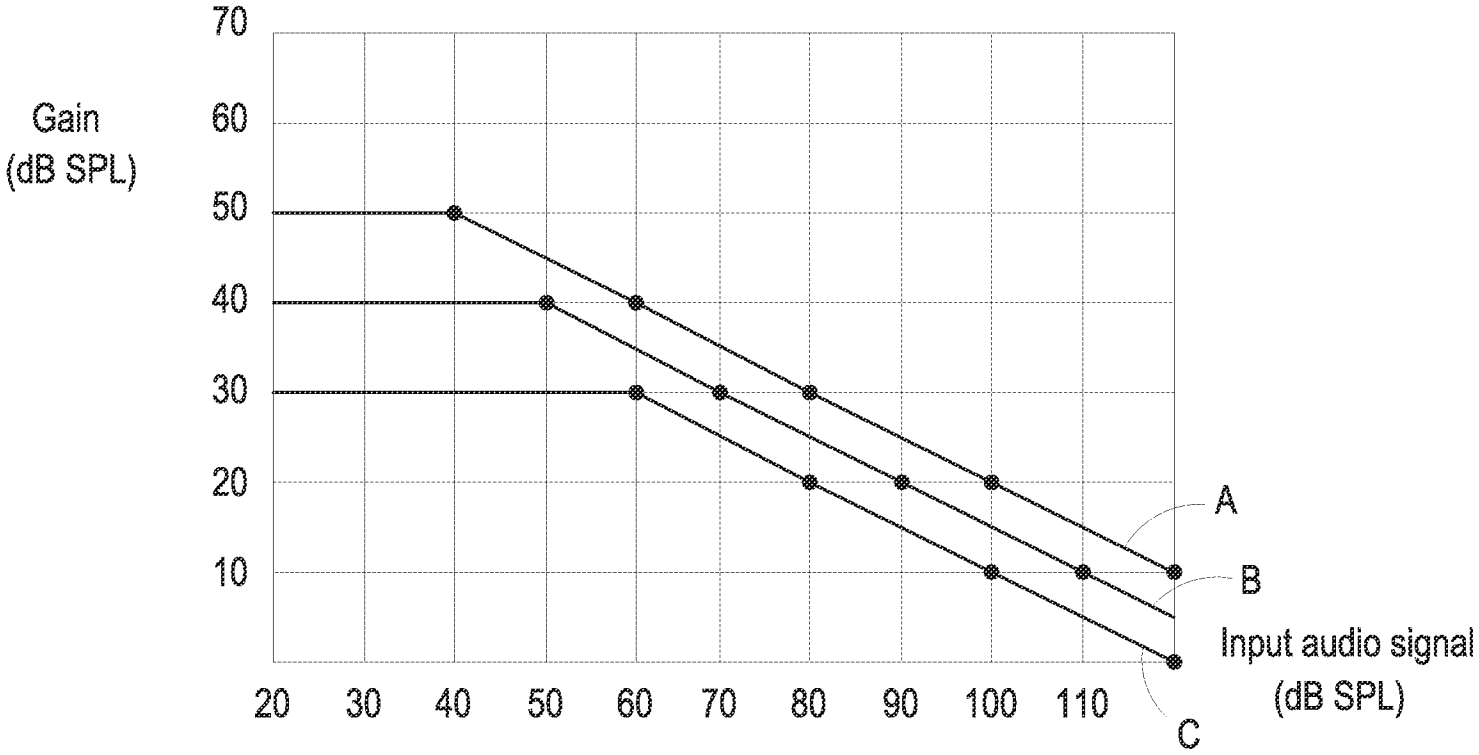
FIG. 2 PRIOR ART
FIG. 2 is a schematic diagram illustrating the relationship between the input audio signal and the basic gain of the control-output compression-type programmable hearing aid as shown in FIG. 1.

In the following embodiment, the audio adjustment parameters corresponding to the curve B' are pre-recorded in the hearing aid 1, and the audio adjustment parameters corresponding to the curve B' are identical to those corresponding to the curve B as shown in FIG. 2.

An example of the audio processing unit 11 includes but is not limited to a microcontroller, a processor, a digital signal processor (DSP), or an application-oriented integrated circuit (not shown). The audio processing unit 11 further includes a wide dynamic range compressor (not shown). The audio processing unit 11 is used to receive the input audio signals and utilize the wide dynamic range compressor.

When the set output volume level is adjusted to be equal to the default volume level through the volume adjustment unit 13, the audio processing unit 11 determines whether the input audio signal is converted into the output audio signal at the first audio compression rate or the second audio compression rate according to the preset volume compression threshold.

When the set output volume level is adjusted to be higher than or lower than the default volume level through the volume adjustment unit 13, the audio processing unit 11 calculates a dynamic volume compression threshold (or referred to as a dynamic knee point). Moreover, according to the dynamic volume compression threshold, the audio processing unit 11 determines whether the input audio signal is converted into a first output audio signal at the first audio compression rate or converted into a second output audio signal at the second audio compression rate.

The speaker unit 12 (e.g., loudspeaker) receives the first output audio signal or the second output audio signal from the audio processing unit 11 and converts the first output audio signal or the second output audio signal into an output sound source (i.e., the real output volume level of the hearing aid 1), so that the output sound source is outputted to be heard by the user.

Please refer to FIG. 3. The self-adaptive adjustment method of the present invention includes the following steps.

In a step S1, the sound receiving unit 10 of the hearing aid 1 receives an external sound source and converts the external sound source into an input audio signal.

In a step S2, the input audio signal is converted into a first output audio signal at a first audio compression rate by the audio processing unit 11, and the first output audio signal is converted into an output sound source by the speaker unit 12. In the step S2, a difference between the first output audio signal and the input audio signal is a first gain value.

In a step S3, a relative relation between the set output volume level and the default volume level of the hearing aid 1 is determined. When the determining result indicates that an offset value is formed between the set output volume level and the default volume level, the audio processing unit 11 calculates a dynamic volume compression threshold according to the preset volume compression threshold, the second audio compression ratio and the offset value formed between the set output volume level and the default volume level, and compares and determines whether the volume of the input audio signal is greater than the dynamic volume compression threshold. In the step S3, as the set output volume level of the hearing aid 1 is decreased, the dynamic volume compression threshold is increased. When the set output volume level of the hearing aid 1 is adjusted to be higher than the default volume level, the dynamic volume compression threshold is lower than the preset volume compression threshold. Whereas, when the set output volume level of the hearing aid 1 is adjusted to be lower than the default volume level, the dynamic volume compression threshold is higher than the preset volume compression threshold.

If the determining result of step S3 indicates that the input audio signal is higher than the dynamic volume compression threshold, a step S4 is performed. In the step S4, the input audio signal is converted into a second output audio signal at a second audio compression rate by the audio processing unit 11, and the second output audio signal is converted into the output sound source by the speaker unit 12. A difference between the second output audio signal and the input audio signal is a second gain value.

Moreover, when the determining result of step S3 indicates that the input audio signal is lower than or equal to the dynamic volume compression threshold, the step S2 is repeatedly done.

Please refer to FIGS. 5 and 6 again. In FIGS. 5 and 6, three curves A', B' and C' corresponding to three different set output volume levels are shown. The curve A' represents that the set output volume level of the hearing aid 1 is adjusted to the maximum volume level. The curve B' represents that the set output volume level of the hearing aid 1 is reduced by 10 dB SPL from the maximum volume level. The curve C' represents that the set output volume level of the hearing aid 1 is reduced by 20 dB SPL from the maximum volume level.

For each of the curves A', B' and C', the input audio signal is converted into the first output audio signal at the first audio compression rate by the audio processing unit 11 before the knee point. Before the knee point, the gain value represented by the vertical axis shown in FIG. 6 is the first gain value. In addition, the input audio signal is converted into the second output audio signal at the second audio compression rate by the audio processing unit 11 after the knee point. After the knee point, the gain value represented by the vertical axis shown in FIG. 6 is the second gain value.

Please refer to FIGS. 5 and 6 again. The dynamic volume compression threshold corresponding to the curve A' is 30 dB SPL. The preset volume compression threshold corresponding to the curve B' is 50 dB SPL. The dynamic volume compression threshold corresponding to the curve C' is 70 dB SPL.

As shown in FIGS. 5 and 6, in the step S2, the first gain value is changed with the change of the set output volume level of the hearing aid 1. When the set output volume level of the hearing aid 1 is fixed, the first gain value is fixed. For example, when the set output volume level of the hearing aid 1 is adjusted to the maximum volume level corresponding to the curve A', the first gain value is 50 dB. When the set output volume level of the hearing aid 1 is reduced by 10 dB SPL from the maximum volume level (i.e., the curve B'), the first gain value is 40 dB. When the set output volume level of the hearing aid 1 is reduced by 20 dB SPL from the maximum volume level (i.e., the curve C'), the first gain value is 30 dB.

As shown in FIGS. 5 and 6, in the step S4, the second gain value is changed with the change of the input audio signal. When the input audio signal is lower than a set threshold and keeps at any constant value, the second gain value is changed with the change of the set output volume level of the hearing aid 1. Whereas, when the input audio signal is higher than or equal to the set threshold and keeps at any constant value, the second gain value is not changed with the change of the set output volume level of the hearing aid 1.

Figure 1:
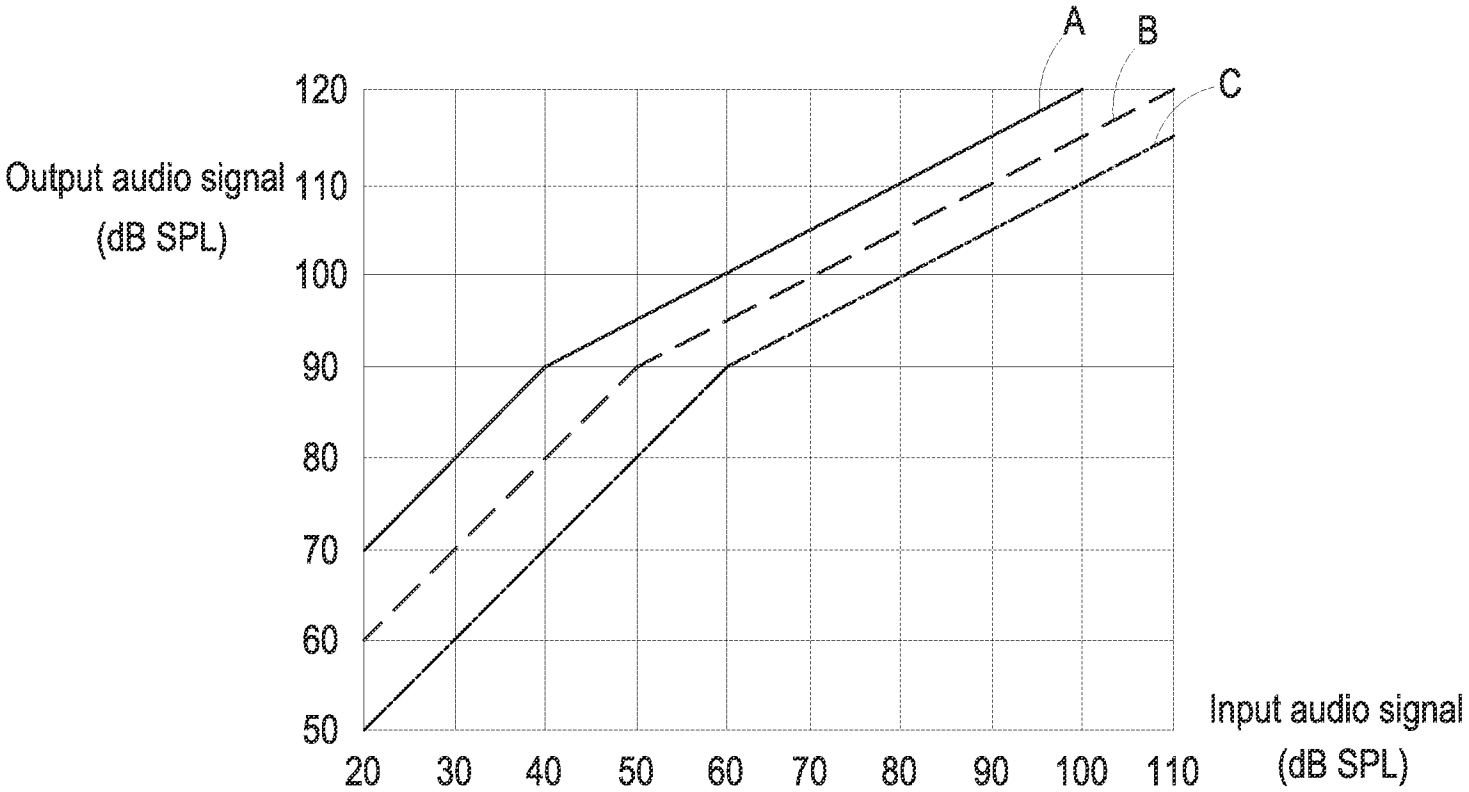
FIG. 1 PRIOR ART
FIG. 1 is a schematic diagram illustrating the relationship between the input audio signal and the output audio signal of a conventional control-output compression-type programmable hearing aid when the wide dynamic range compression is performed at three set output volume levels.

In the embodiment, the audio adjustment parameters corresponding to the curve B' are pre-recorded in the hearing aid 1, and the audio adjustment parameters corresponding to the curve B' are identical to those corresponding to the curve B as shown in FIGS. 1 and 2. Please refer to FIGS. 5 and 6 as well as the FIGS. 1 and 2. In a situation, the set output volume level is adjusted to be higher than the default volume level through the volume adjustment unit 13. For example, the set output volume level corresponding to the curve B' is adjusted to the set output volume level corresponding to the curve A', the dynamic volume compression threshold corresponding to the curve A' is 30 dB SPL and the corresponding output audio signal is 80 dB SPL. In contrast, the preset volume compression threshold corresponding to the curve A of the conventional hearing aid is 40 dB SPL and the corresponding output audio signal is 90 dB SPL (see FIGS. 1 and 2). That is, under the condition that the set output volume level is higher than the default volume level, the hearing aid 1 of the present invention can compress the input audio signal at the second compression rate in replace of the first compression rate in advance. Consequently, when the user adjusts the sound volume, it is not necessary to frequently enable the maximum power output (MPO) limiting function, and the instantaneous loud volume is not over-amplified to cause discomfort to the user.

In another situation, the set output volume level is adjusted to be lower than the default volume level through the volume adjustment unit 13. For example, the set output volume level corresponding to the curve B' is adjusted to the set output volume level corresponding to the curve C', the dynamic volume compression threshold corresponding to the curve C' is 70 dB SPL and the corresponding output audio signal is 100 dB SPL. In contrast, the preset volume compression threshold corresponding to the curve C of the conventional hearing aid is 60 dB SPL and the corresponding output audio signal is 90 dB SPL (see FIGS. 1 and 2). In other words, when the set output volume level is adjusted to be lower than the default volume level, the hearing aid 1 of the present invention has a wider dynamic range.

Moreover, when the input audio signal is higher than the dynamic volume compression threshold, the input audio signal is converted into the second output audio signal at the second audio compression rate by the audio processing unit 11, and when the input audio signal is higher than or equal to the set threshold and keeps at any constant value, the second gain value is not changed with the change of the set output volume level of the hearing aid 1. For example, when the input audio signal is higher than 70 dB SPL (i.e., after g70), the second gain value is not changed with the change of the set output volume level of the hearing aid 1. Since the calculation procedure of the hearing aid 1 is simpler when the input audio signal is higher than 70 dB SPL, the computing cost of the hearing aid 1 is reduced.

In some embodiments, in the step S3, when the set output volume level is adjusted to be higher than the default volume level through the volume adjustment unit 13, the dynamic volume compression threshold is calculated by using the following mathematic formula (1). Whereas, when the set output volume level is adjusted to be lower than the default volume level through the volume adjustment unit 13, the dynamic volume compression threshold is calculated by using the following mathematic formula (2). The mathematic formulae (1) and (2) can be expressed as:

$$Kd=Kp-Com2\times dB1 \quad (1)$$

$$Kd=Com2\times dB2+Kp \quad (2)$$

In the above mathematic formulae, Kd is the dynamic volume compression threshold, Kp is the preset volume compression threshold, dB1 is the offset value between the set output volume level and the default volume level when the set output volume level is adjusted to be higher than the default volume level, Com2 is the second audio compression rate, and dB2 is the offset value between the set output volume level and the default volume level when the set output volume level is adjusted to be lower than the default volume level.

From the above descriptions, the present invention provides a self-adaptive adjustment method and a hearing aid using the self-adaptive adjustment method. When the set output volume level is adjusted to be higher than or lower than the default volume level, the dynamic volume compression threshold is calculated. According to the dynamic volume compression threshold, the input audio signal is converted into the output audio signal at the first audio compression rate or the second audio compression rate. Consequently, when the user adjusts the sound volume, it is not necessary to frequently enable the maximum power output (MPO) limiting function, and the instantaneous loud volume is not over-amplified to cause discomfort to the user. In addition, the sound dynamic range is wider, and the computing cost of the hearing aid is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A self-adaptive adjustment method for a hearing aid, wherein at least one audio adjustment parameter is previously stored in the hearing aid, the at least one audio adjustment parameter comprises a first audio compression rate, a second audio compression rate and a preset volume compression threshold, the preset volume compression threshold is adapted as a set output volume level is equal to a default volume level of the hearing aid, and the self-adaptive adjustment method comprises:

(S1) receiving an external sound source, and converting the external sound source into an input audio signal;

(S2) converting the input audio signal into a first output audio signal at a first audio compression rate, and converting the first output audio signal into an output sound source, wherein a first gain value exists between the first output audio signal and the input audio signal;

(S3) determining a relative relation between the set output volume level and the default volume level of the hearing aid, wherein when the determining result indicates that an offset value is formed between the set output volume level and the default volume level, calculates a dynamic volume compression threshold according to the preset volume compression threshold, the second audio compression ratio and the offset value, and compares and determines whether the volume of the input audio signal is greater than the dynamic volume compression threshold; and (S4) converting the input audio signal into a second output audio signal at a second audio compression rate, and converting the second output audio signal into the output sound source, wherein a second gain value exists between the second output audio signal and the input audio signal, wherein when the determining result of the step (S3) indicates that the volume of the input audio signal is higher than the dynamic volume compression threshold, the step (S4) is performed, wherein when the determining result of the step (S3) indicates that the volume of input audio signal is lower than or equal to the dynamic volume compression threshold, the step (S2) is repeatedly done.

2. The self-adaptive adjustment method according to claim 1, wherein in the step (S3), when the set output volume level of the hearing aid is adjusted to be higher than the default volume level, the dynamic volume compression threshold is calculated according to a mathematic formula (1), wherein in the step (S3), when the set output volume level of the hearing aid is adjusted to be lower than the default volume level, the dynamic volume compression threshold is calculated according to a mathematic formula (2), wherein the mathematic formula (1) and the mathematic formula (2) are expressed as:

$$Kd=Kp-Com2\times dB1 \quad (1)$$

$$Kd=Com2\times dB2+Kp \quad (2)$$

wherein Kd is the dynamic volume compression threshold, Kp is the preset volume compression threshold, dB1 is the offset value between the set output volume level and the default volume level when the set output volume level is adjusted to be higher than the default volume level, Com2 is the second audio compression rate, and dB2 is the offset value between the set output volume level and the default volume level when the set output volume level is adjusted to be lower than the default volume level.

3. The self-adaptive adjustment method according to claim 1, wherein the first audio compression rate is greater than the second audio compression rate.

4. The self-adaptive adjustment method according to claim 1, wherein when the set output volume level is decreased, the dynamic volume compression threshold is increased.

5. The self-adaptive adjustment method according to claim 1, wherein in the step (S4), the second gain value is changed with a change of the input audio signal, wherein when the input audio signal is lower than a set threshold and keeps at a constant value, the second gain value is changed with a change of the set output volume level, wherein when the input audio signal is higher than or equal to the set threshold and keeps at a constant value, the second gain value is not changed with the change of the set output volume level.

6. The self-adaptive adjustment method according to claim 5, wherein the set threshold is 70 dB SPL.

7. The self-adaptive adjustment method according to claim 1, wherein the hearing aid is an automatic gain control-output compression-type programmable hearing aid.

8. The self-adaptive adjustment method according to claim 1, wherein when the set output volume level is adjusted to be higher than the default volume level, the dynamic volume compression threshold is lower than the preset volume compression threshold, wherein when the set output volume level is adjusted to be lower than the default volume level, the dynamic volume compression threshold is higher than the preset volume compression threshold.

9. The self-adaptive adjustment method according to claim 1, wherein the first gain value is changed with a change of the set output volume level.

* * * * *